United States Patent [19]

Pettyjohn et al.

[11] 4,327,526

[45] May 4, 1982

[54] APPARATUS FOR GRINDING THE INTERNAL WALLS OF PIPES

[75] Inventors: William H. Pettyjohn, Chattanooga; John T. Lewis, Hixson, both of Tenn.; William E. Milligan, deceased, late of Soddy, Tenn., by Thelma K. Milligan, administratrix

[73] Assignee: Combustion Engineering, Inc., Windsor, Conn.

[21] Appl. No.: 162,061

[22] Filed: Jun. 23, 1980

[51] Int. Cl.[3] ..... B24B 5/40

[52] U.S. Cl. ..... 51/245; 409/143; 409/139

[58] Field of Search ..... 51/245, 241 S, 241 R, 51/261; 15/104.09; 409/143, 139, 140

[56] References Cited

U.S. PATENT DOCUMENTS

| | | | |
|---|---|---|---|
| 1,114,376 | 10/1914 | Milkop | 51/245 |
| 1,365,149 | 1/1921 | Breed | 51/245 |
| 3,403,597 | 10/1968 | Beckman et al. | 409/143 |
| 4,116,110 | 9/1978 | Dines | 409/143 |

*Primary Examiner*—Roscoe V. Parker

*Attorney, Agent, or Firm*—Arthur L. Wade

[57] ABSTRACT

A grinder is supported within a pipe, the support being arranged to adjust the movement of the head of the grinder radially and axially of the pipe axis to bear against internal cracks in the pipe wall.

4 Claims, 2 Drawing Figures

APPARATUS FOR GRINDING THE INTERNAL WALLS OF PIPES

TECHNICAL FIELD

The present invention relates to the adjustable support of a grinding machine within a confined space to bring the head of the grinder against predetermined stations at the boundary of the space. More particularly, the invention relates to structure for moving an adjustable grinding machine axially and radially within a pipe in bringing the head of the grinder against the internal wall of the pipe to eliminate cracks in the wall.

BACKGROUND ART

The huge pipes with which feedwater is conducted to steam generators heated by nuclear fission, are beginning to evidence progressive defects. This problem is only one of the myriad of other technical problems descending upon these installations. Fortunately, consistent improvement in inspection apparatus and techniques have given early warnings by spotting the appearance of internal cracks in the walls of these feedwater pipes. Forewarned, the maintenance personnel rise to the occasion by developing tools and techniques to catch these defects in their early stages of development and overcome them.

Thus far, the internal cracks of these feedwater pipes have appeared only in straight runs. But the location, size, and expense of replacement of straight-run sections make it advisable to directly attack the developing defects in situ. Some of the internal cracks can be ground out and leave enough wall thickness for safety. Other cracks are ground out and the depression filled with weld material which is to be ground flush with the internal pipe surface.

Superficially, it would appear that personnel could crawl inside of these rather large pipes and apply a hand-held grinding machine to the cracks. Large as the pipes are, perhaps in the order of 17–18", they remain a limited boundary within which it is difficult, or impossible, to operate hand-held grinding machines effectively. Adjustable support structure for the grinding machine must be provided. Within the boundary of the pipes, personnel can insert and install support apparatus for the grinding machine. The actual radial adjustment of the grinding machine from the axis of the pipe to the predetermined station on the internal wall, and axial movement as required, must be carried out by manual operation of the support structure. Within these specifications, the present invention provides a tool which obviates still another problem in nuclear power generation.

DISCLOSURE OF THE INVENTION

The present invention contemplates a tubular shaft supported between two spiders which engage the internal walls of a pipe to extend the tubular shaft along the axis of the pipe. A grinder head and power source are mounted on extensible structure which is, in turn, mounted on the tubular shaft intermediate the spider supports. The tubular shaft is manually rotatable from one end to position the grinder head on the radial from the axis of the pipe to a predetermined station on the internal wall of the pipe to be ground. Extensible structure in the mounting of the grinder head is manually adjustable to extend the grinder head to the predetermined station. The tubular shaft is manually movable within the spider bearings to provide the complete flexibility movement required for the head of the grinder.

Other objects, advantages and features of this invention will become apparent to one skilled in the art upon consideration of the written specification, appended claims, and attached drawings.

BEST MODE FOR CARRYING OUT THE INVENTION

Some General Observations

Figure 1:
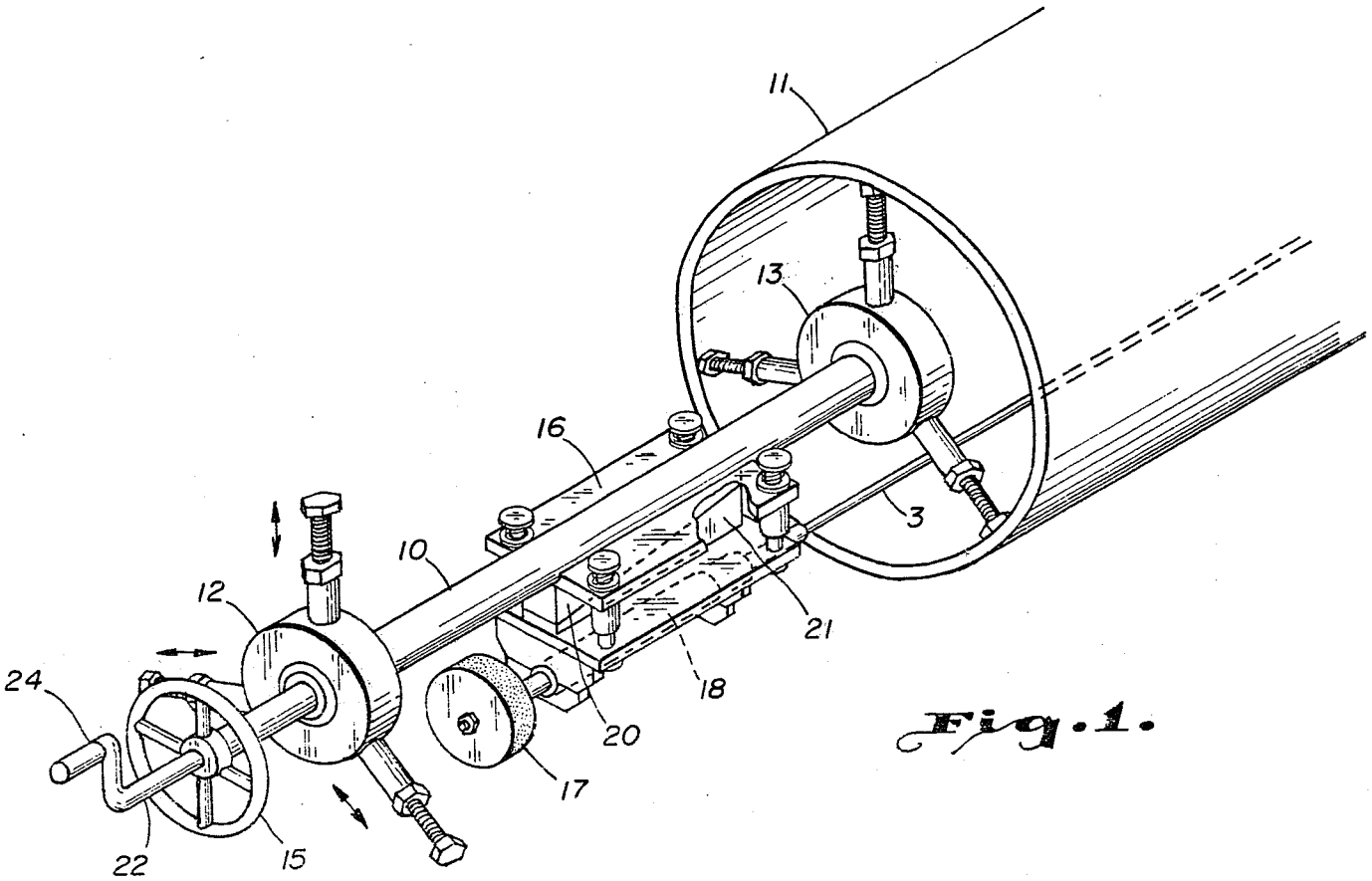
FIG. 1 is an isometric of a pipe with a grinder being inserted into the pipe and supported by structure in which the present invention is embodied.

Realistically, there can hardly be pertinent prior art directly related to the present invention. True, grinder heads, powered by various forms of motors, have been supplied brackets and stands for support and movement to bring the grinder heads into contact with surfaces to be worked. However, the new technology associated with nuclear power has been the first to demand repair of internal cracks in the walls of pipes which can be repaired by grinding out the cracks and filling the grind-outs with fill welds which are then ground even with the internal walls of the pipes. The appearance of the problem is relatively new and, therefore, its solution with the present embodiment of the invention is unlikely to have any close comparison with the prior art.

The internal walls of these pipes represent limiting boundaries within which the repair must take place. For the first time, a repairman is required to supply a tool which will take the grinder head, and its power source, into pipes too small for hand-held grinders. Therefore, the present invention supplies this extension of the repairman's arms and hands into a space from which he is barred by his physical deminsions.

The Drawing

The present invention is embodied in a support structure centralized about a tubular shaft 10. All of the embodying structure of the invention is concentrated around this tubular shaft as it is axially inserted into the pipe whose internal wall is to be repaired.

In FIG. 1 of the drawing, tubular shaft 10 is extended into pipe 11 and mounted in alignment with the pipe axis. Therefore, the orientation begins with this tubular shaft within a pipe, the tubular shaft 10 held in this orientation by spiders 12 and 13.

Spiders 12 and 13 are, essentially, bearings about tubular shaft 10 with legs extensible into engagement with the internal wall of the pipe 11. These bearings permit tubular shaft 10 to be rotated while held in alignment with the pipe axis. Also, the bearings are formed and arranged about the tubular shaft 10 to allow the tubular shaft to be moved axially within the pipe 11. Mounted in spiders 12 and 13, tubular shaft 10 can be both rotated and shifted axially within the pipe while in support of a grinder.

The legs provided for each bearing of the spiders 12 and 13 must be at least three in number. The legs of each bearing, radiating from their bearing, are extensible. As disclosed in the drawings, the end of each leg is provided a jack screw which can be manually manipulated to effectively extend the length of its leg to bring the end of the leg into contact with the internal wall of the pipe 11.

Spider-supported tubular shaft 10 is manually controlled in its rotation and longitudinal shift within the spider bearings through wheel 15 attached to one end. Rotated with wheel 15, tubular shaft 10 is thereby positioned to bring its section, which is intermediate spiders 12 and 13, over the predetermined station on the internal wall of pipe 11 where the defect to be repaired is located. Another way of expressing this arrangement and function, is to point out that a grinder structure mounted on the external wall of tubular shaft 10 is positioned at that radial between the pipe axis and the predetermined station on the internal wall of the pipe 11.

The grinder structure which performs the end result of the inventive embodiment is mounted on support structure 16. This grinder structure is comprised of grinder head 17 and motor 18, linked to support structure 16 through extensible wedges 20, 21.

Wedge 20 is moved parallel to the axis of pipe 11 by rod 22. Rod 22 extends from connection with wedge 20 at support structure 16 through the tubular shaft 10. Handle 24 is provided for manual rotation of rod 22 with which wedge 20 is moved. Movement of wedge 20 by this structure slides the wedge surfaces of 20 and 21 over each other to, in result, extend the grinder head to the predetermined station on the internal wall of pipe 11.

Figure 2:
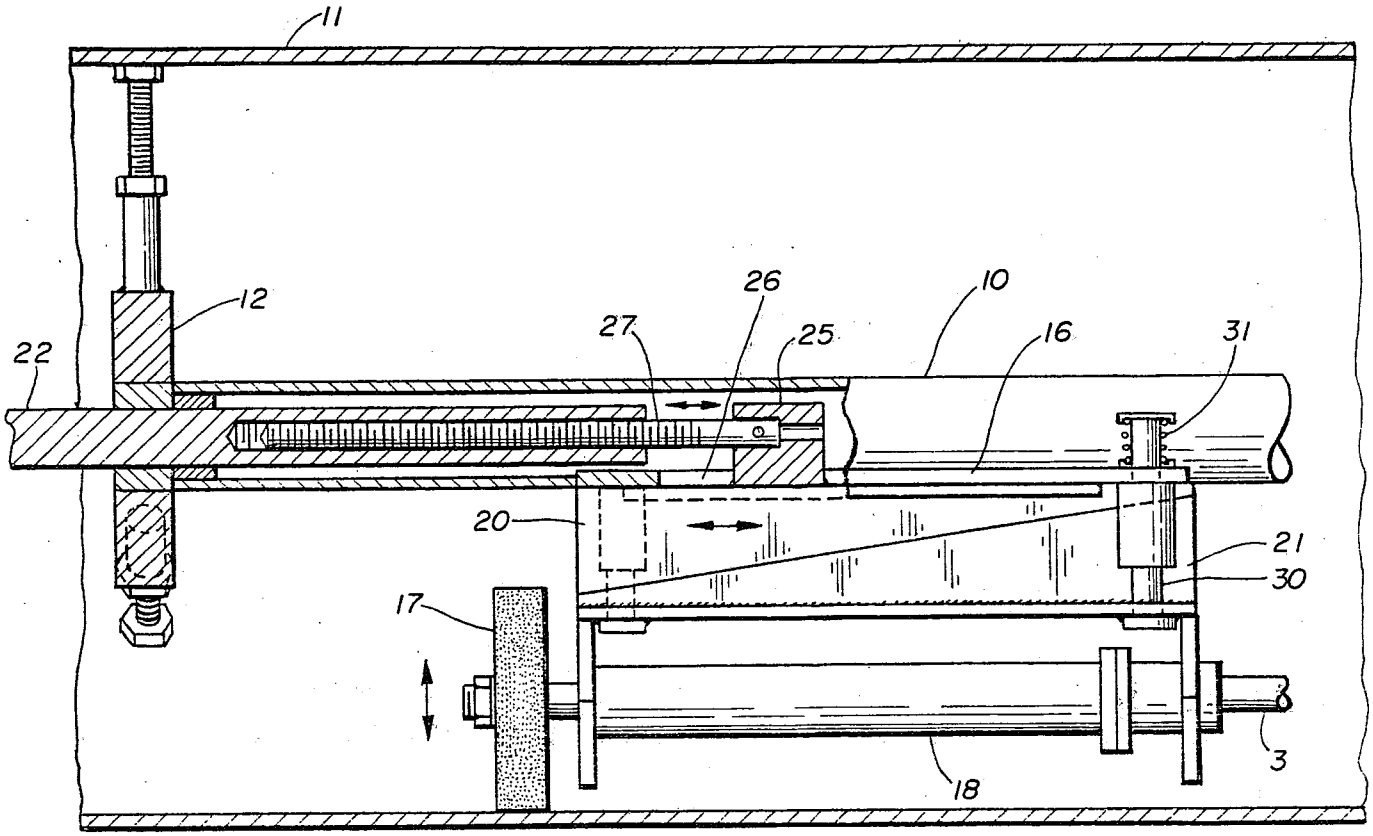
FIG. 2 is a section of a portion of FIG. 1 disclosing the operation of the wedge extension.

FIG. 2 is established to disclose more completely and clearly the arrangement and cooperation between rod 22, wedges 20 and 21, and the structure connected to them. Support structure 16 has been sectioned to disclose the connection between wedge 20 and the end of rod 22.

Support structure 16 is, effectively, a saddle housing mounted at an intermediate location on tubular shaft 10. Wedge 20 is formed with an upwardly-projecting superstructure 25 connecting to the end of rod 22. Superstructure 25 projects into housing 16 through a slot 26. With the front end of rod 22 held in a fixed relation to tubular shaft 10, the rotation of the front end of rod 22 results in movement of wedge 20 along its track on support saddle 16.

Rod 22 is telescopic so that the rotation of its front end by handle 24 will cause an elongation of the rod as an assembly. The two halves of the rod 22 are connected to each other through a worm gear at 27. Therefore, rotation of the handle 24 in one direction will cause elongation of the rod 22, and reverse rotation will cause retraction. With the front end of the rod fixed to the tubular shaft 10 and the rear end of the rod 22 connected to wedge 20, rotation of the handle 24 will cause wedge 20 to shift its position parallel to the axis of the tubular shaft.

Wedge 21 is fixed to the top of motor 18. These two structures, as a unit, are attached to housing 16 by parallel rods 30. Obviously, the rods 30 may be fixed to motor housing 18 and slide in holes formed in housing 16 to receive the rods. Alternatively, rods 30 may be fixed to housing 16 and slide in holes formed in motor housing 18 to receive the rods. In either event, the wedge 21-motor housing 18 is limited to straight-line travel to and from housing 16. The result is, that as wedge 20 is moved horizontal to the axis of tubular shaft 10, the contacting surfaces of wedge 20 and wedge 21 cause the motor housing 18 to advance and retreat between the axis of tubular shaft 10 and the wall of the pipe within which it is mounted. The retreat of the wedge-housing unit from the pipe wall is powered by springs 31.

Operation

Full access into a straight run of pipe 11 is provided. Inspection locates the defects to be repaired on the inside wall of pipe 11. Tool embodiment of the present invention is inserted into the end of the straight-run of pipe 11 to bring grinder head 17 into a working contact with the defect to be repaired.

The repairman mounts spider 13 in pipe 11. The jack screws on the ends of the spider legs are wrenched into contact with the pipe wall and measurements are made to simultaneously center the spider bearing with the axis of the pipe. Tubular shaft 10 has its forward end slipped into the bearing of spider 13 and spider 12 receives the opposite end of tubular shaft 10. Spider 12 has its arms jacked into position against the wall of pipe 11, the bearing being aligned with the bearing of spider 13 and the axis of pipe 11.

Suitable stops on tubular shaft 10 establish the longitudinal travel of the shaft in the bearings on the spider, the range of travel being suitable for grinder head 17 to work a length of the defect in the pipe wall. Handwheel 15 is mounted on tubular shaft 10. Handle 24 is mounted on the end of rod 22. The repairman then rotates wheel 15 to bring grinder head 17 to the radial extending from the axis of the pipe to the station on the internal wall of the pipe where the defect has been ascertained. Handle 24 is then rotated to move wedge 20 to extend grinder wheel 17 into engagement with the defective pipe wall. By coordinating the rotation of wheel 15 and handle 24, grinder head 17 is then moved both axially and radially to grind out the crack in the wall of pipe 11.

As previously indicated, the defective crack may be ground out and leave sufficient wall thickness to insure safety in conducting fluids through pipe 11. If necessary, the ground out pipe wall may be filled by weld material and such filler material ground flush with the internal surface of the pipe. In all events, tool embodying the present invention provides an effective extension of the hands and arms of repairmen to effectively apply grinder head 17 to defects in the internal wall of pipe 11.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

We claim:

1. An apparatus for grinding at a station on the internal wall of a pipe, including, a pipe having stations on its internal wall requiring grinding, a tubular shaft adapted to be inserted into the pipe with an intermediate portion opposite the station at which grinding is to take place, a spider structure mounted at each end of the tubular shaft arranged to engage the wall of the pipe and support the tubular shaft along the axis of the pipe, bearing structure between the support spiders and the tubular shaft through which the tubular shaft is moved axially within the pipe and rotated by an attached handwheel, a support assembly mounted intermediate the spider-supported ends of the tubular shaft, extension structure mounted on the support assembly including a pair of wedges with one of the wedges positioned parallel the axis of the tubular shaft by a manually operated rod extended through the tubular shaft from one end of the shaft, and a motor and grinder head connected to the extension structure to be moved radially to bring the grinder head into engagement with the internal wall of the pipe at the predetermined station.

2. The apparatus of claim 1, wherein, the connection between the rod and wedge is a screw connection and the rod is fixed relative to the tubular shaft in order for rotation of the rod to move the wedge through the screw connection.

3. An adjustable support structure for a grinding machine adapted to be mounted within a pipe to bring the head of the grinding machine into operative engagement with a defective area on the internal wall of the pipe, including, a pair of spiders adapted to be mounted a predetermined distance apart within a pipe to align their central bearings with the pipe axis, a tubular shaft positioned within the aligned spider bearings so as to substantially coincide its axis with the pipe axis, a wheel mounted on the end of the tubular shaft to be accessible to manual control of the wheel by which the shaft is rotated and axially shifted within the spider bearings, a rod mounted on the tubular shaft extended axially through the shaft from the wheel end of the shaft and rotatable within the shaft, a wedge member mounted on the tubular shaft at a location between the spider bearings and engaging the end of the rod for movement by the rotated rod, and a grinding machine mounted on the tubular shaft through slidable connections and engaging the wedge member so as to be radially moved relative to the pipe axis by the movement of the wedge member.

4. The support structure of claim 3, including a wedge surface on the grinder arranged to be contacted by the wedge member which is moved to give the radial movement, and a spring member between the tubular shaft and grinder to urge the wedge surfaces into contact with each other.

* * * * *